US005338115A

United States Patent [19]

Gregg

[11] Patent Number: 5,338,115

[45] Date of Patent: Aug. 16, 1994

[54] MIXING DEVICE FOR MATERIALS WITH LARGE DENSITY DIFFERENCES

[75] Inventor: David W. Gregg, Moraga, Calif.

[73] Assignee: The United States of America as represented by the United States Department of Energy, Washington, D.C.

[21] Appl. No.: 989,305

[22] Filed: Dec. 11, 1992

[51] Int. Cl.[5] ..... B01F 5/12

[52] U.S. Cl. ..... 366/263; 366/266; 366/270; 366/295; 415/88; 416/175; 416/198 R; 416/203

[58] Field of Search ..... 415/88, 89, 121.1, 121.3, 415/143; 416/175, 176, 198 R, 203; 261/93; 366/64–67, 163, 164, 244–247, 249–251, 262–266, 270, 279, 292, 293, 295, 309, 312, 313, 318, 325, 329, 330, 343

[56] References Cited

U.S. PATENT DOCUMENTS

| | | | |
|---|---|---|---|
| 134,706 | 1/1873 | Schultze | 366/262 |
| 328,585 | 10/1885 | Hornbostel | 366/266 X |
| 2,016,647 | 10/1935 | McMartin | 366/270 |
| 2,298,317 | 10/1942 | Smith | 252/32 |
| 2,348,123 | 5/1944 | Green et al. | 366/164 X |
| 2,626,788 | 1/1953 | Ragland . | |
| 3,229,449 | 1/1966 | Hogue | 366/266 X |
| 3,607,124 | 9/1971 | Zippel . | |
| 3,615,243 | 10/1971 | Scott . | |
| 3,746,314 | 7/1973 | Nauta . | |
| 3,813,083 | 5/1974 | Risse | 366/263 |
| 4,188,132 | 2/1980 | Lenart et al. | 366/314 |
| 4,232,973 | 11/1980 | Ligouzat | 366/157 |
| 4,764,022 | 8/1988 | DiVita | 366/157 |

FOREIGN PATENT DOCUMENTS

| | | | |
|---|---|---|---|
| 5716852 | 4/1982 | Japan | 366/247 |
| 1614916 | 12/1990 | U.S.S.R. | 366/65 |
| 1270106 | 4/1972 | United Kingdom | 415/121.1 |

*Primary Examiner*—Timothy F. Simone
*Assistant Examiner*—Charles Cooley
*Attorney, Agent, or Firm*—Henry P. Sartorio; Roger S. Gaither; William R. Moser

[57] ABSTRACT

An auger-tube pump mixing device for mixing materials with large density differences while maintaining low stirring RPM and low power consumption. The mixing device minimizes the formation of vortexes and minimizes the incorporation of small bubbles in the liquid during mixing. By avoiding the creation of a vortex the device provides efficient stirring of full containers without spillage over the edge. Also, the device solves the problem of effective mixing in vessels where the liquid height is large compared to the diameter. Because of the gentle stirring or mixing by the device, it has application for biomedical uses where cell damage is to be avoided.

9 Claims, 2 Drawing Sheets

MIXING DEVICE FOR MATERIALS WITH LARGE DENSITY DIFFERENCES

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to mixing or stirring devices, particularly to a device for mixing materials with large density differences, and more particularly to such a device which provides gentle stirring (low RPM) and minimizes the formation of vortexes and bubbles during mixing thereby provides for stirring of full containers without spillage.

Mixing or stirring devices of various types are known for numerous different applications. These prior mixing or stirring arrangements are exemplified by the following U.S. Pat. Nos. 2,626,788 issued Jan. 27, 1953 to D. Ragland; 3,746,314 issued Jul. 17, 1973 to C. J. Nauta; 4,188,132 issued Feb. 12, 1980 to W. Lenart et al.; 4,232,973 issued Nov. 11, 1980 to P. Sigouzat; and 4,764,022 issued Aug. 16, 1988 to A. DiVita.

One of the problems with prior known mixing mechanisms is that they create a vortex and or produce small bubbles in the liquid, which in many cases is the result of high speed mixing in order to achieve mixing of materials with large density differences. Also, because of the created vortex spilling of the mixture over the edge of an open container is caused during mixing. Therefore, this is a need in the mixing/stirring art for a mixing or stirring device which operates at a low RPM to minimize the formation of a vortex and small bubbles, while effectively mixing materials of large density differences.

The present invention fills the above-mentioned need by providing a mixing device which operates at low speed, thus providing effective, but gentle stirring of materials with a variety of densities, while minimizing the formation of a vortex and/or small bubbles and enables stirring or mixing of full containers without spillage.

SUMMARY OF THE INVENTION

It is an object of the present invention to provide a means for mixing or stirring of materials with large density differences.

It is a further object of the invention to provide a device for stirring or mixing materials which operates at a low speed and with low power consumption.

A further object of the invention is to provide a mixing or stirring device which minimizes the formation of vortexes and the incorporation of small bubbles in the liquid during operation.

Another object of the invention is to provide a device which allows efficient stirring of full containers without spillage.

Another object of the invention is to provide a device for effectively mixing in vessels having a liquid height which is substantially greater compared to the diameter of the vessel.

Another object of the invention is to provide a mixing device which enables drawing material from the bottom of a mixing vessel and preventing undesired build-up of solid materials in the bottom of the vessel.

Other objects and advantages of the present invention will become apparent from the following description and accompanying drawing. Basically, the mixing device of this invention includes an auger-tube pump mixing or stirring arrangement, which operates at a relatively low speed and is provided with a propeller arrangement for withdrawing material from the bottom area of a container, and is particularly adapted for mixing materials having a large density difference. Due to the low speed of the mixing device, and thus the reduction in power consumption, the creation of vortexes in the material being mixed is minimized. Due to the gentle stirring of the mixing device, such has application in the biomedical field where cell damage is to be avoided, as well as where the liquid height is large compared to the liquid diameter.

BRIEF DESCRIPTION OF THE DRAWINGS

The accompanying drawings, which are incorporated into and forms a part of the disclosure, illustrates an embodiment of the invention and, together with the description, serve to explain the principles of the invention.

DETAILED DESCRIPTION OF THE INVENTION

Figure 1:
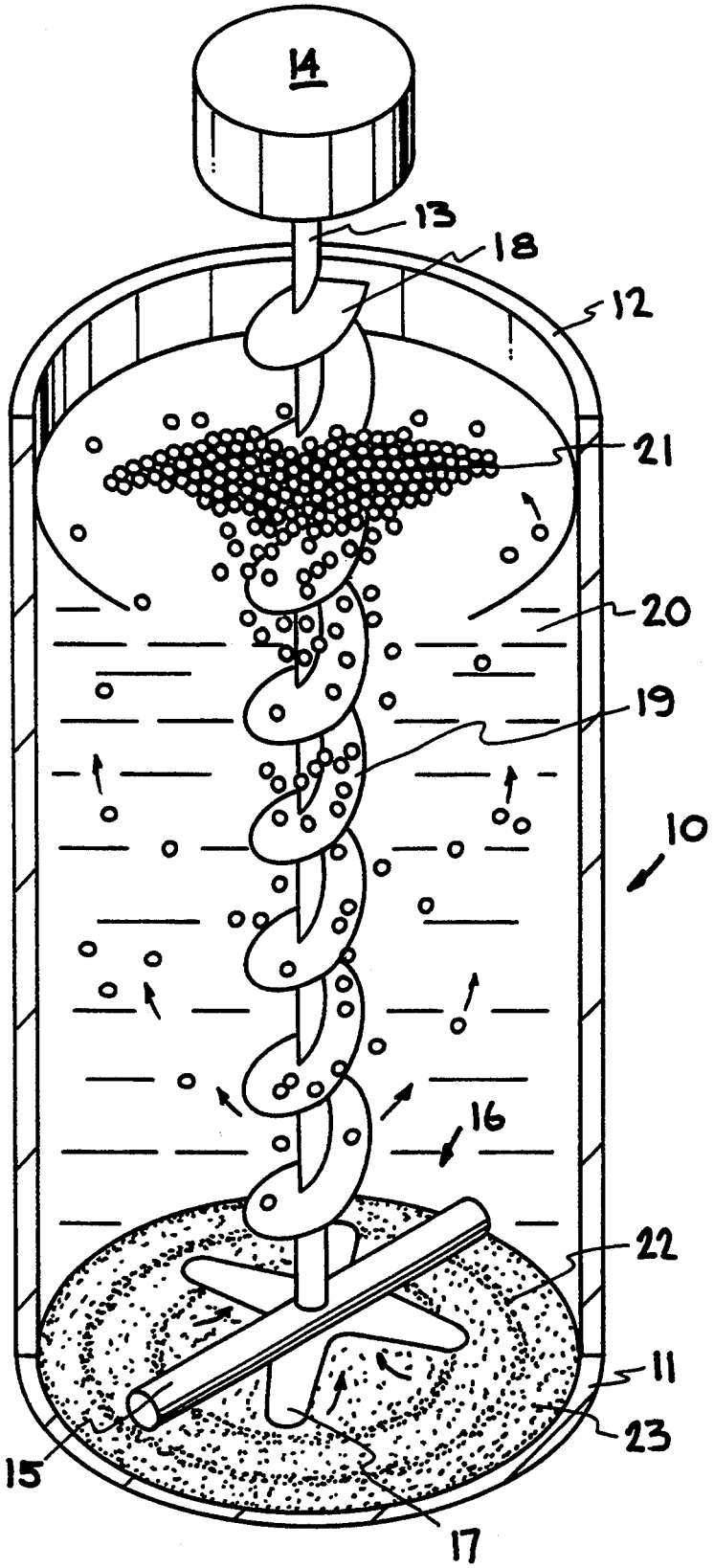
FIG. 1 illustrates an embodiment of the mixing device of the present invention.

The present invention is directed to a mixing or stirring mechanism that is effective at achieving mixing of materials with large density differences while maintaining a low stirring speed (RPM) and low power consumption. Importantly, the mechanism of this invention minimizes the formation of a vortexes and minimizes the incorporation of small bubbles in the liquid. By avoiding or minimizing the formation of vortexes and providing a gentle stirring action efficient stirring of full open containers can be accomplished without spillage. As a result of this gentle stirring varies applicants, such as in the biomedical field and where the liquid height is large compared to the liquid diameter.

The present invention arose as a need in the field for a mixing device for materials having a density from 1.5 to 17, as the result of providing for mixing molten salt (density of 2.2), calcium metal (density of 1.5), plutonium oxide (density of 12), and plutonium metal (density of 17) in an open reaction crucible for a tilt-pour furnace at a temperature of 800° C., and with the crucible having a depth of about twice the diameter (10 inches deep, 5 inch diameter). To satisfy the specific need for the mixing of materials with large difference in density, under which the invention arose, the tilt-pour furnace arrangement additionally required an open top reaction crucible with a flat bottom, the driving shaft could penetrate only from the center top, no baffles could be used, the stirring elements must be withdrawable into a four (4) inch clearance between the top of the crucible and a heat shield above it, with the heat shield only having a single 1.25 inch access hole. In addition, the plutonium metal product must be separated from the salt with minimum residual left in the salt due to the formation of fine droplets that do not settle in time. Thus, the embodiment of the invention illustrated in the drawing designed to satisfy the specific application described above. However, such is not intended to limit the invention to this specific embodiment or for this specific application, and the specific description is only intended to explain the principles of the invention.

As pointed out above and which will become more apparent from the following description, the principle advantages of this invention over other known mixing or stirring devices is the elimination or substantial reduction of vortexes, the ability to gently stir material in a container filled near to the top without spillage due to stirring, the ability to gently stir material wherein the height thereof is substantially greater than the width, the ability to withdraw higher density materials from the bottom of a mixing container while reducing or preventing such materials from being deposited around the bottom periphery of the container. These advantages are accomplished by the auger-tube pump arrangement to which is attached a propeller positioned to operate near the flat bottom of the mixing container, and which are driven at a low RPM and with low power consumption. It is the low speed that minimizes the formation of vortexes in the mixture, and the lack of vortexes produces the above-references advantages.

Figure 2:
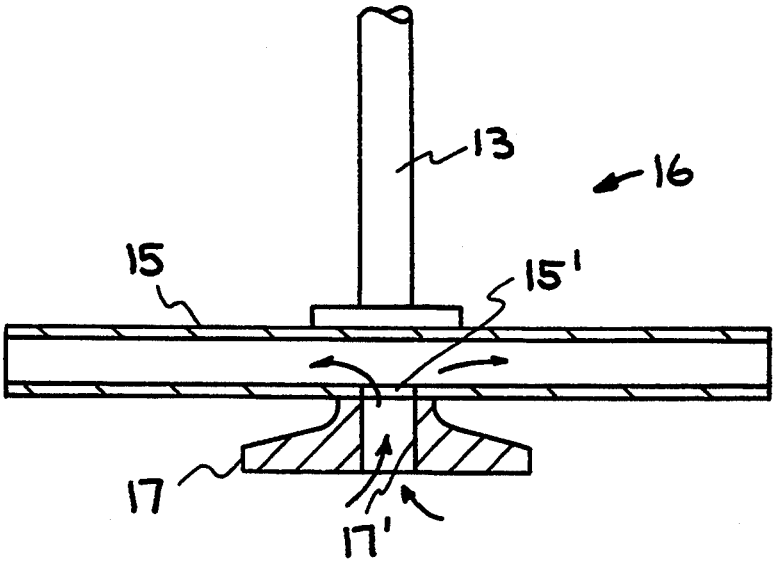
FIG. 2 illustrates in cross-section, the central openings in the propeller and the tube pump of the FIG. 1 embodiment.

Referring now to the embodiment of the invention illustrated in the drawings, the mixing or stirring mechanism or device comprises a container 10 having a flat bottom 11 and open top 12, such as a reaction crucible of a tilt-pour furnace having a heat shield, not shown, located in a spaced relation above the crucible and having an opening therein. A driver shaft or rod 13 extends through the heat shield and to which is connected a speed controlled power or rotation source or driving mechanism, generally indicate at 14. The driver shaft 13 extends into container 12 and is connected at a lower end to a hollow pipe or tube 15 having an opening 15', see FIG. 2, in the lower surface thereof to form a tube pump 16. A propeller 17, also having a centrally located opening 17', see FIG. 2, in alignment with the bottom opening in tube 15, is secured to tube 15. In this embodiment the propeller 17 is of a four (4) highly pitched blade configuration. However, the propeller 17 may utilize other blade configurations, and for certain applications may be omitted. A spiral member 18 is secured around driver shaft 13 forming an auger 19. In this specifically described application the container 10 contains a molten salt 20 to which is added calcium metal pellets 21, and plutonium oxide 22, for the production of a molten plutonium metal product 23.

By way of example, with the container of crucible 10 having a height of 10 inches and a 5 inch diameter. The shaft 13 is constructed of tantalum, stainless steel or plastic with a diameter of ½ inch, the tube 15 being constructed of 4 inch length, ¼ diameter copper, tantalum, stainless steel, or plastic with an ⅜ inch opening on the bottom surface. The propeller 17 is constructed of the same materials as tube 15 and has an overall length or diameter of 2 inches and the central hole or opening therein is ¼ inch, with the blades being pitched at an angle of 0° to 90° and located ½ inch above the bottom 11 of container 10. The spiral member 18 secured to shaft 13 forming auger 19 is constructed of copper, tantalum, stainless steel, or plastic with a pitch of 1.5 inch, diameter of 1 inch, and a length of 8 inches, but may have a different pitch depending on the application or materials involved. The mixing or stirring speed was carried out in the range of 200 RPM to 600 RPM, and the temperature was 800°-850° C. The liquid height increase created by stirring at 200 RPM was no more than ⅛ inch, with test materials selected to be substantially equal in densities to the materials described above.

The present invention as illustrated in the drawings prevents an accumulation of the heavy or higher density material such as plutonium oxide 22 in the circular "corner" between the flat bottom 11 and the vertical cylindrical wall of container 10 while stirring slowly enough to avoid generating a deep vortex. This is accomplished by the tube pump 16, while at the same time preventing accumulation of materials at the central bottom zone of container 10. When the tube 15 having a central opening therein facing downward is rotated, a negative pressure will be generated at the open ends of the tube 15, sucking material upwards from the bottom 11 of container 10 into the central opening and propels such outwardly through the tube by the centrifuge effect, thereby causing a jet motion and preventing build-up at the outer periphery ("corner") of the container bottom 11, while eliminating build-up at the central bottom zone.

In tests conducted to verify the advantages of the tube pump 16, it was determined that larger stirrer diameters (producing by the length of tube 15) can be operated at low (200) RPM and effectively dislodge the heavy material build-up at the "corner" of container 10 by the generation of a radial fluid "jet", while eliminating build-up in the central zone thereof. It was also noted from these tests that once started, the more the tube 15 loads with the heavy material via the central opening, the more powerful the centrifuge effect and the better it worked as a pump. Thus, it will not be easy to saturate its material carrying capacity. These tests also verified that the heavy material from the bottom center zone of the container would be sucked into the tube pump 16 with it being located a distance of at least one inch from the bottom 11 of container 10.

The propeller 17 prevents accumulation of a "ring" of the heavy material between the bottom central zone and the above-described "corner" of the container 10, when only the tube pump 16 is utilized. This "ring" of material is not totally stagnant, but tests established that improved agitation of the "ring" was beneficial. With the four blade propeller 17 having the blades highly pitched the material in the "ring" was pumped upwardly through the aligned central openings in the propeller 17 and the tube 15 into the tube 15 and outwardly by the centrifuge effect described above. In this manner the propeller 17 assisted the tube pump 16 in establishing a circulation pattern drawing heavy material along the bottom from the outside "corner" towards the center zone without producing an intermediate "ring" of material.

The auger 19 enables the mixing of the low density material 21 such as calcium metal (density of 1.5) which is inserted into container 10 at the open top end 12, and must be mixed down into the material 20, such as molten salt, having a density of 2.2, as well as drawing the heavy material 22, such as plutonium oxide (density of 12) upwardly. The molten salt 20 may be $CaCl_2$ or $CaCl_2/CaF_2$. The calcium 21, with a melting point of 839° C., will start as ⅛ inch pellets, but commonly becomes molten due to a temperature spike driven by exothermic chemical reactions when the molten salt 20 is at 800° C. Tests using lead powder to simulate plutonium powder were conducted using a 1–1.25 inch auger 19 showed that it was extremely effective at mixing the calcium (Ca) pellets 21 into the molten salt 20 at very low (200) RPM where the increase in the liquid (molten salt) height due to minimal vortex generation was no more than ⅛ inch.

With a 1 inch diameter auger 19 combined with a 4 inch long, ½ inch diameter tube pump 16 and a 2 inch diameter pitched four-bladed propeller 17, it has been established by simulation testing that 200 RPM was sufficient for the pump action to work adequately with the tube pump located ½ inch above the heavier (high density) material at the bottom of the container 12, while adequately producing mixing of the Ca pellets 21 (density of 1.5) in the molten salt 20 (density of 2.2) and plutonium oxide 22 (density of 12) for producing the molten plutonium metal product 23 (density of 17), while also preventing material build-up in the "corner" and bottom central zone of the container 10, and while producing a minimal liquid height increase due to minimizing generation of a vortex in the mixture.

It is recognized that when the auger/tube pump mixing/stirring device of FIG. 1 is utilized for different materials, the propeller 17 may be omitted provided there is no circulation problem along the bottom of the container due to the above-described intermediate "ring". The auger/tube pump mixer of this invention may be utilized for mixing various materials, particularly those having large density differences, and/or those requiring gentle mixing/stirring motion, as well mixing conditions where the liquid height is much greater than the liquid diameter. The mixing/stirring device is particularly effective where catalyst pellets are mixed into a fluid without destroying the pellets.

While the embodiment of the invention described and illustrated is adapted for use in a tilt/pour furnace with a closely located heat shield and operating at a selected temperature, the invention need not be associated with a furnace or require any specific temperature operation. Various applications for the auger/tube pump arrangement of this invention, with or without a propeller, for gently mixing various materials, preferably at low speed without generating or minimizing generation of a vortex during mixing, thereby providing for stirring or mixing substantially full containers.

While a specific embodiment has been illustrated and described, and specific materials, parameters, etc. have been described, such is not intended to limit the invention. Modifications and changes will become apparent to those skilled in the art, and the scope of the invention is to be limited only the scope of the appended claims.

What is claimed is:

1. A mixing device for materials with large density differences, comprising:

a container having a closed bottom and open top, and within which materials are to be mixed:

an auger extending into said container;

a tube pump connected at one side thereof to said auger and located within said container;

a propeller secured to a side opposite to said one side of said tube pump, and includes a plurality of outwardly extending blades and is provided with a central opening therein aligned with an opening in said opposite side of said pump; and means for rotating said auger, said propeller and said tube pump.

2. The mixing device of claim 1, wherein said plurality of blades are pitched at an angle of 0° to 90° with respect to a horizontal plane.

3. The mixing device of claim 1, wherein said tube pump comprises a hollow tube having said opening through which material enters said hollow tube, and having a length sufficient to enable dislodging of material from an outer periphery of said container by material discharging from an outer end of said hollow tube when said tube pump is rotated.

4. The mixing device of claim 1, wherein said rotating means includes means which is controlled such that said auger and said tube pump are rotated at about 200 RPM.

5. The mixing device of claim 1, wherein said auger includes a driving shaft and a spiral member mounted around said shaft.

6. The mixing device of claim 5, wherein said spiral member has a pitch of about 1–2 inches.

7. The mixing device of claim 5, wherein said spiral member has a pitch of about 1.5 inches and a diameter of about 1 inch; wherein said tube pump comprises a tube having a length of about 4 inches, a diameter of about ¼ inch, and said opening having a diameter of about ⅜ inch; and wherein said container has a diameter of about 5 inches and a height of about twice the diameter.

8. The mixing device of claim 7, wherein said container has a substantially flat bottom, and wherein said propeller has four blades, a diameter of about 2 inches, and said central opening having a diameter of about ¼ inch.

9. The mixing device of claim 1, wherein said container has a substantially flat bottom.

* * * * *